United States Patent [19]

Nitsch

[11] Patent Number: 4,967,222

[45] Date of Patent: Oct. 30, 1990

[54] METHOD OF AND MACHINES FOR TREATING WEBS OF PHOTOGRAPHIC MATERIAL

[75] Inventor: Wilhelm Nitsch, Munich, Fed. Rep. of Germany

[73] Assignee: Agfa-Gevaert AG, Leverkusen, Fed. Rep. of Germany

[21] Appl. No.: 414,947

[22] Filed: Sep. 29, 1989

[30] Foreign Application Priority Data

Oct. 4, 1988 [DE] Fed. Rep. of Germany ..... 3833733

[51] Int. Cl.[5] ..... G03D 3/13

[52] U.S. Cl. ..... 354/321; 354/298; 354/322; 226/108; 226/119

[58] Field of Search ..... 354/319, 320, 321, 322, 354/298; 355/27; 226/108, 118, 119

[56] References Cited

U.S. PATENT DOCUMENTS

| | | | |
|---|---|---|---|
| 3,913,119 | 10/1975 | Pfeifer et al. | 354/321 |
| 4,260,234 | 4/1981 | Burton | 354/319 |
| 4,304,484 | 12/1981 | Mizuta et al. | 354/321 |
| 4,621,970 | 11/1986 | Wurfel | 414/412 |
| 4,643,371 | 2/1987 | Wurfel et al. | 242/55 |
| 4,732,278 | 3/1988 | Zangenfeino et al. | 198/406 |
| 4,782,354 | 11/1988 | Gregoris | 354/322 |
| 4,888,613 | 12/1989 | Zangenfe | 355/41 |
| 4,894,675 | 1/1990 | Wurfe et al. | 354/308 |

FOREIGN PATENT DOCUMENTS 2353601 4/1982 Fed. Rep. of Germany .

*Primary Examiner*—A. A. Mathews

*Attorney, Agent, or Firm*—Peter K. Kontler

[57] ABSTRACT

A web of spliced-together exposed photographic films is introduced into a developing machine at a variable speed. In order to ensure that each increment of the web is treated in the developing tank of the developing machine for an optimum interval of time, the speed of web advancing rolls at the inlet of the developing tank is monitored and the thus obtained signals are used to regulate the speed of advancing rolls at the outlet of the developing tank in such a way that the two speeds match but the speed of advancing rolls at the outlet is changed to conform to changed speed of advancing rolls at the inlet with a delay corresponding to the optimum interval of time. The length of that portion of the web which extends between the two sets of advancing rolls is varied simultaneously with changes of the speed of advancing rolls at the outlet.

29 Claims, 5 Drawing Sheets

METHOD OF AND MACHINES FOR TREATING WEBS OF PHOTOGRAPHIC MATERIAL

BACKGROUND OF THE INVENTION

The invention relates to improvements in methods of and in machines for treating webs of photographic material, such as photographic roll films and photographic paper.

Exposed photographic films, especially color films, just be developed in such a way that each and every increment of the film is treated for a predetermined interval of time. This is particularly important in connection with the treatment of exposed films in the developing and fixing baths of the developing machine, especially in the developing bath. The quality of developed images is adversely affected not only if the interval of treatment in the developing bath is too short but also if the duration of treatment exceeds a predetermined optimum interval. Therefore, presently known developing machines are designed in such a way that the developing tank contains a predetermined quantity of developing solution and the film is transported through the bath along a path of predetermined length and at a predetermined speed. This ensures that each and every increment of the film is contacted by the developing solution for a desired interval of time.

A drawback of conventional developing machines which are capable of ensuring that each and every increment of an exposed film will be contacted by developing solution for an optimum interval of time is that they cannot be directly coupled to other machines in a photographic processing laboratory or in a like establishment. The reason is that the machine or machines which precede the developing machine cannot always deliver films at a speed which is required during transport of films through the developing, fixing and rinsing baths of a standard developing machine for color photographic films. For example, if the developing machine is to receive a very long web which is obtained by splicing a large number of exposed photographic roll films end-to-end, the speed of the web at the outlet of the splicing machine often fluctuates within a rather wide range. Therefore, it is customary to confine the long web of spliced-together photographic roll films in a light-tight cassette and to deliver the cassette to the developing machine where the web is drawn from the cassette at a constant speed which is required to guarantee that each and every increment of the web will be treated (at least in the developing tank) for a predetermined interval of time. The developed web is convoluted on the core of a reel and is transferred into a copying machine where the images of film frames are copied on photographic paper. The photographic paper is thereupon developed in a separate developing machine and is subdivided into prints which are confined in envelopes, together with sections of corresponding films, for shipment or delivery to dealers in photographic materials and cameras or directly to customers.

The total period of time which is taken up for splicing discrete exposed roll films end-to-end, for confining the resulting web in a cassette, for transferring the cassette to a developing machine, for developing the web, and for collecting the developed web on a reel is a multiple of the period of time which elapses while the films and the web are advanced in the splicing machine and the web is advanced in the developing machine. The splicing machine normally comprises or is combined with means for automatically removing exposed but undeveloped customer films from their cartridges, for trimming the leaders of discrete films, for separating the trailing ends of films from cartridges, for discarding the cartridges, for advancing the leaders of successive trimmed and separated films to the splicing station into proper position with reference to the trailing end of the growing web of spliced-together films, for splicing the leaders to the adjacent trailing end of the web, and for confining the web in a lighttightly sealed cassette for transport to the developing machine. In the developing machine, the leader of a web which is confined in the cassette is attached to a band which serves to thread the leader through the baths and through the drying unit of the developing machine. It is also known to attach the leader of a fresh web directly to the trailing end of the preceding web of spliced-together photographic roll films.

If the films which are spliced together to form a web are not provided with notches in predetermined positions relative to the film frame, the developing machine is followed by a notching machine which provides the web with at least one notch for each film frame in order to ensure proper positioning of film frames with reference to the copying instrumentalities in the printer which images the frames onto photographic paper. In addition, the notches serve to ensure proper subdivision of exposed and developed films into sections of optimum length, e.g., into sections each of which contains four or six film frames, which can be readily inserted into standard customer envelopes together with the respective prints.

It is a well known fact that the overall period of time which is required to process a customer film, starting with removal of the film from its cartridge and ending with insertion of film sections and corresponding prints into the pockets of a customer envelope, is a multiple of that period of time during which the films and the corresponding lengths of photographic paper are actually treated, i.e., withdrawn from cartridges, spliced together with other customer films, developed, copied, subdivided and introduced into envelopes. An acceleration of the processing operation by placing a developing machine for exposed customer films and/or a developing machine for photographic paper in line with other machines, such as a splicing machine for customer films and a printer for transfer of images of exposed and developed film frames onto photographic paper, is not possible in view of the aforediscussed mode of operation of presently known developing machines, namely in view of the need to transport a web of coherent customer films or a long web of photographic paper at a fixed speed.

Attempts to assemble one or more developing machines with one or more other machines which are needed in connection with the processing of customer films include the provision of large magazines which are installed ahead of the developing machines and are designed to store considerable lengths of exposed but undeveloped photographic material so as to compensate for eventual fluctuations of the outputs of machines which precede the developing machines. Such proposals have met with limited success because a large variable-capacity magazine is expensive and takes up much space. In addition, each magazine must be designed to prevent penetration of any light since it serves to store undeveloped photographic films or undeveloped photographic paper. Moreover, each magazine causes a pronounced lengthening of the path for transport of photographic material. Additional time is lost when a photographic processing laboratory or a similar establishment employs lengths of flexible band material which is used to thread the leaders of webs of spliced-together photographic films or the leaders of webs of photographic paper through the respective magazines. In addition, the utilization of such bands necessitates the provision of additional storing, advancing and splicing facilities which contribute to the bulk and cost of the developing and other processing operations even though the cost of bands is much less than the cost of photographic roll films. As a rule, the width of such bands matches the width of films or the width of photographic paper.

Commonly owned German Pat. No. 23 53 601 to Pfeifer et al. discloses a developing machine wherein the tank for a supply of treating liquid has advancing rolls at the inlet, advancing rolls at the outlet, and guide elements which direct the leader of a web of exposed but undeveloped photographic material from the advancing rolls at the inlet toward the advancing rolls at the outlet. Once the leader reaches the outlet, the guide elements are retracted and the web is caused to form a loop by gravity. By appropriate selection of the speed of the web and by appropriate selection of the size of the looped portion of the web between the inlet and the outlet, the developing machines of Pfeifer et al. ensures that each increment of the web is treated for a predetermined interval of time. A drawback of the patented developing machine is that it cannot be directly coupled to one or more other machines except by the provision of a large variable-capacity magazine for temporary storage of the web ahead of the inlet to the tank.

OBJECTS OF THE INVENTION

An object of the invention is to provide a novel and improved method of rapidly processing exposed but undeveloped photographic roll films and/or exposed but undeveloped photographic paper.

Another object of the invention is to provide a novel and improved method of combining one or more developing machines with one or more other machines which are utilized in photographic processing laboratories and like establishments for the treatment of exposed but undeveloped photographic films and/or for the treatment of exposed but undeveloped photographic paper.

A further object of the invention is to provide a method which renders it possible to directly couple a developing machine with another machine ahead of or behind the developing machine without the need for large variable-capacity magazines between such machines.

An additional object of the invention is to provide a novel and improved method of processing photographic customer films in a combination of machines including a splicing and a developing machine.

Another object of the invention is to provide a novel and improved method of treating photographic paper in a printer and in a developing machine which receives photographic paper from the printer.

Still another object of the invention is to provide a method which renders it possible to shorten the period of time which elapses between removal of exposed but undeveloped photographic customer films from their cartridges and the insertion of sections of exposed and developed films and corresponding prints into customer envelopes.

A further object of the invention is to provide a novel and improved method of treating exposed but undeveloped photographic material in developing machines.

An additional object of the invention is to provide a novel and improved combination of machines for the treatment of photographic customer films and photographic paper in such a way that it is possible to dispense with large variable-capacity magazines ahead of the developing machine or machines.

Another object of the invention is to provide a production line which can be used in a photographic processing laboratory or in a similar establishment for the processing of customer films and for the making of prints of exposed and developed film frames.

A further object of the invention is to provide a novel and improved developing machine which can be used in the above outlined production line.

Another object of the invention is to provide a combination of machines including at least one developing machine wherein each and every increment of each and every film or each and every increment of photographic paper is developed for an optimum interval of time, even if the developing machine receives films or webs of coherent films or photographic paper at a variable speed.

Still another object of the invention is to provide a novel and improved combination of a developing machine for exposed photographic roll films and a printer wherein the images of film frames are copied onto photographic paper or other suitable photographic material.

A further object of the invention is to provide a combination of machines which need not employ considerable lengths of flexible band material in lieu of exposed but undeveloped roll films.

Another object of the invention is to provide a developing machine with a novel and improved developing tank, with a novel and improved fixing tank, with a novel and improved rinsing tank and with a novel and improved drying unit for photographic material.

An additional object of the invention is to provide the developing machine with novel and improved means for advancing webs of photographic material through a developing, fixing or rinsing tank.

Still another object of the invention is to provide a production line which can employ certain standard machines in combination with the above outlined developing machine or machines.

SUMMARY OF THE INVENTION

One feature of the present invention resides in the provision of a method of advancing a running web of photographic material (such as a series of exposed photographic roll films which are spliced together end-to-end or a web of photographic paper) in a predetermined direction along an elongated path having a first path portion extending through a first machine (e.g., a machine in which successive roll films are spliced together end-to-end or a printer wherein images of film frames are copied onto photographic paper) from which successive increments of the web are discharged (at least at times) at different speeds, and a second path portion extending through a developing machine in at least one part (e.g., the developing or fixing tank) of which each increment of the web should undergo treatment for a predetermined interval of time. The improved method comprises the steps of monitoring the speed of the upstream or inlet end of the second path portion, and varying the speed of the web at the downstream or outlet end of the second path portion in response to detected changes of the speed of the web at the upstream end so that each increment of the web remains in the second path portion for the predetermined interval of time. The method can further comprise the step of varying the length of the second portion of the path (and hence the length of the web in the at least one part of the developing machine) simultaneously with the speed varying step.

A second part of the developing machine can define a third path portion wherein each increment of the web should undergo treatment for a preselected interval of time. For example, the at least one part of the developing machine can include a developing bath and the second part of such machine can include a fixing bath. The method then further comprises the step of varying the speed of the web at the downstream or outlet end of the third path portion in response to changes of the speed of the web at the downstream end of the second path portion so that each increment or unit area of the web remains in the third path portion for the preselected interval of time. This method can also include the additional step of varying the length of the third path portion (and hence the length of the web in the second part of the developing machine) simultaneously with the step of varying the speed of the web at the downstream end of the third path portion.

Each speed varying step can include conforming the speed of the web at the downstream end of the second or third path portion to the speed of the web at the upstream end of the second or third path portion, and such method further comprises the step of delaying the speed conforming step for each increment of the web by the predetermined or preselected interval following detection of the speed of successive increments at the upstream end of the second or third path portion, respectively.

The speed of the web at the upstream end of the second or third path portion can be varied stepwise, and the method can further comprise the step of monitoring the length of the web in the second and/or third portion of the path.

Another feature of the invention resides in the provision of a combination of machines for processing at least one running web of photographic material, e.g., a web of spliced-together photographic roll films and/or a web of photographic paper. The improved combination comprises a first machine which defines for the web a first portion of an elongated path and comprises means (e.g., a variable-capacity magazine) for discharging the web (at least at times) at different speeds, and a developing machine which includes at least one part (e.g., a developing tank) defining for the web a second portion of the path downstream of the first portion and serving to subject successive increments of the web to a treatment which should last for a predetermined interval of time. The developing machine further comprises means for monitoring the speed of the web at the upstream end of the second path portion, and means for varying the speed of the web at the downstream end of the second path portion in response to detected changes of speed at the upstream end of the second path portion so that each increment of the web remains in the second path portion of the predetermined interval of time.

The monitoring means can include means for generating signals denoting the length of the web in the at least one part of the developing machine.

In accordance with a presently preferred embodiment, the monitoring means includes first variable-speed web advancing means (e.g., a pair of advancing rolls which define a nip for the web) and means for generating signals which denote the speed of the first advancing means. The speed varying means of such developing machine includes second variable-speed web advancing means and means for driving the second advancing means at a speed which is a function of the intensity and/or an other characteristic of signals generated by the signal generating means and denoting the speed of the first advancing means. The driving means can include a prime mover for the second advancing means and means for regulating the speed of the prime mover as a function of signals from signal generating means. The regulating means preferably comprises a computer with input means connected to the signal generating means and output means connected to the prime mover. The computer preferably comprises a memory for the signals and is operative to vary the speed of the second advancing means in such a way that the speed of the second advancing means conforms to the speed of the first advancing means with a delay corresponding to the predetermined interval of time. The monitoring means can further comprise additional prime mover means serving to drive the first advancing means at a limited number of different speeds, e.g., at three different speeds. Such developing machine further comprises adjusting means for varying the length of the second path portion as a function of signals from the signal generating means so as to lengthen the second portion in response to increasing speed of the first advancing means and vice versa.

The adjusting means can comprise a first set of guide rolls for the web in the at least one part of the developing machine, a second set of guide rolls for the web in the at least one part of the developing machine, and means for moving at least one set of guide rolls relative to the other set. If the at least one part includes a developing or fixing tank, the other set of guide rolls is preferably installed in the tank at a level above the at least one set, and the moving means preferably includes means for moving the at least one set up and down nearer to and further away from the other set. The developing machine can further comprise signal generating means for monitoring the level of the at least one set in the tank, and the moving means is then responsive to signals from such level monitoring means. The computer can include additional output means for transmission of signals to the adjusting means in accordance with the equation $$L(t_1) = \int_{t_1 - T}^{t_1} V_{in}(t)\, dt$$

wherein $V_{in}(t)$ is the speed of the web at the upstream end of the second portion of the path, L is the length of the second path portion, and T is the predetermined interval of time.

The second advancing means preferably includes means (e.g., including one or more friction wheels) for applying to the web a pull which is below the braking or tearing strength of the web.

In accordance with another presently preferred embodiment of the developing machine, the adjusting means for varying the length of the second path portion includes means for directing at least one fluid stream (e.g., a stream of developing or fixing liquid) against the web intermediate the first and second advancing means so that the stream or streams loop the web between the first and second advancing means, signal generating detector means for monitoring the length of the second path portion (i.e., the length of the web in the tank), and means for regulating the operation of the stream directing means as a function of signals from the detector means. The detector means can comprise one or more photoelectronic detectors operating with radiation in the non-actinic region. Such developing machine preferably further comprises means for guiding the leader of the web from the first to the second advancing means, and such guiding means is movable between an operative position in which it actually guides a leader from the first to the second advancing means and an inoperative position in which the stream or streams of fluid can loop the web between the first and second advancing means. The developing machine further comprises detector means which is operative to initiate a movement of the guiding means to inoperative position in response to detected advancement of the leader of the web beyond the second advancing means.

The first machine can include means for splicing a plurality of strips of photographic material (e.g., exposed but undeveloped photographic roll films) end-to-end, a variable capacity magazine which is provided for the web between the splicing means and the first advancing means, detector means for monitoring the operation of the splicing means and for generating signals in the event of malfunction, and means for varying the speed of the first advancing means in response to detected malfunction of the splicing means. Such first machine can further comprise means for supplying to the splicing means at least one band of flexible material in lieu of one or more strips of photographic material in response to a reduction of the capacity of the magazine to a predetermined minimum acceptable value.

The developing machine can further include a drying unit which receives the web from a tank of the developing machine and can supply the web to a third machine, particularly a printer wherein images of film frames are copied onto a web of photographic paper. As a rule, the printer contains an exhaustible supply of photographic paper which must be replaced from time to time with attendant stoppage of the printer. The capacity of the drying unit to store a web of photographic material is preferably selected in such a way that the drying unit can temporarily store that length of the web which has been delivered from the at least one part of the developing machine while the operation of the printer was interrupted in order to replace an exhausted supply of photographic paper.

A second developing machine can be installed downstream of the printer to develop photographic paper. Such second developing machine defines an additional portion of the path. This additional portion can extend through the developing or fixing bath of the second developing machine wherein the speed at the downstream end is regulated in the same way as described above for the developing machine behind the splicing machine (i.e., ahead of the printer). When the printer is arrested for a short period of time which is needed to restore the supply of photographic paper, the speed of the first advancing means in the second developing machine is reduced together with the length of the web in the at least one part of the second developing machine. If the operation of the printer is interrupted for a longer period of time the web of photographic paper is transported at a reduced speed and is ultimately arrested once the length of the web of photographic paper in the at least one part of the second developing machine is reduced to a predetermined minimum value. A length of flexible material other than a film or photographic paper can be attached to the web, or the latter can include a length of non-exposed photographic paper.

The novel features which are considered as characteristic of the invention are set forth in particular in the appended claims. The improved combination itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
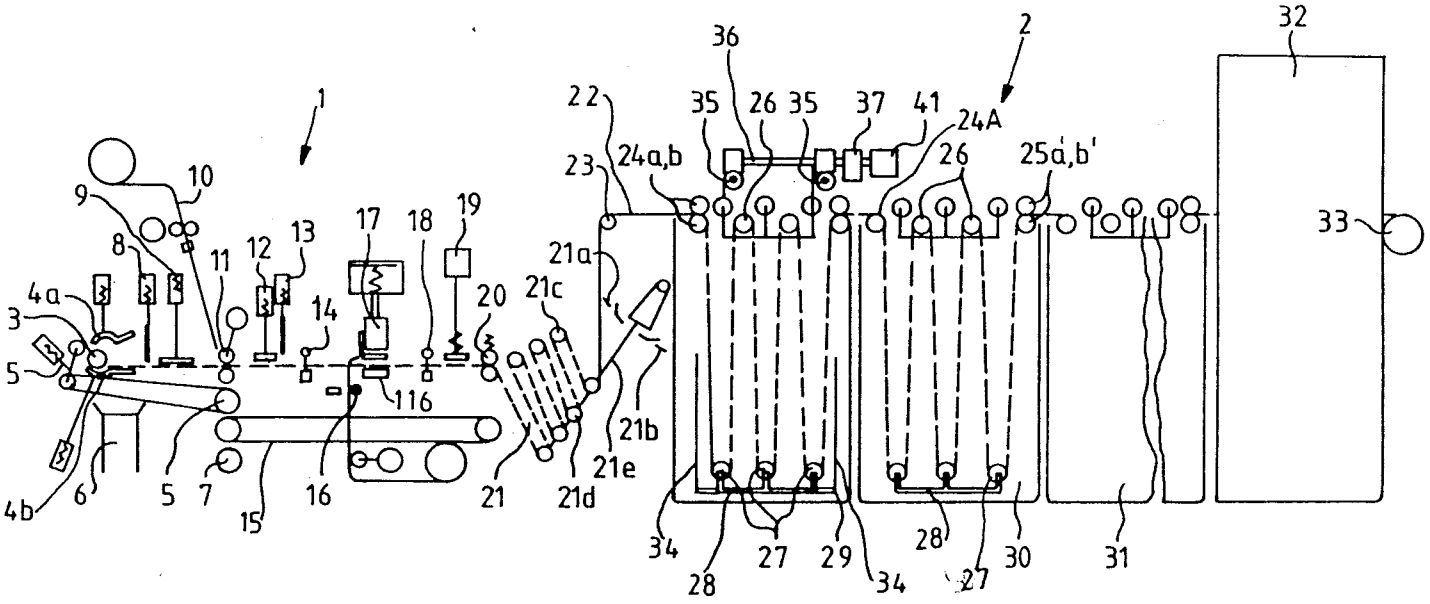
FIG. 1 is a schematic elevational view of a combination of a film splicing machine and a developing machine for a web of spliced-together photographic roll films.

FIG. 1 shows the combination of a film splicing machine 1 with a developing machine 2 for exposed photographic roll films. The machine 1 is designed to splice together 135-films or other commercially available films. Such films are supplied to a processing laboratory (either by dealers or directly by customers) in standard cassettes which must be opened preparatory to withdrawal of reels 3 with films convoluted on the cores of the respective reels. Reference may be had to commonly owned U.S. Pat. No. 4,621,970 granted Nov. 11, 1986 to Würfel et al., and to commonly owned U.S. Pat. No. 4,732,278 granted Mar. 22, 1988 to Zangenfeind et al. The reels are held during unwinding of the respective films and the films are trimmed, separated from the cores of the respective reels 3, spliced together end-to-end to form a long web 22, and the web is thereupon advanced through the developing machine 2.

The machine 1 is or can be similar to that disclosed in commonly owned U.S. Pat. No. 4,643,371 granted Feb. 17, 1987 to Würfel et al. The disclosure of this patent is incorporated herein by reference. Similar machines are disclosed in commonly owned U.S. patent application Ser. No. 264,398 filed Oct. 28, 1988, now U.S. Pat. No.

4,888,613, and in commonly owned copending U.S. patent application Ser. No. 264,806 filed Oct. 28, 1988, now U.S. Pat. No. 4,894,675. FIG. 1 merely shows certain components of the splicing machine 1, namely those which are necessary for an understanding of the operation of this machine. Thus, a cartridge which is introduced into the machine 1 is relieved of one of its end walls so that the reel and the exposed but undeveloped film on the core of the reel can be expelled from the shell of the cartridge by moving the reel axially. The reel 3 is introduced into the chamber of a housing including two sections 4*a*, 4*b* at least one of which is movable relative to the other section to permit introduction of a loaded reel 3 and evacuation of a reel which has been relieved of photographic film.

When a loaded (film-carrying) reel 3 is properly received in the chamber, the movable section (e.g., 4*a*) or sections are moved to closed positions to retain the reel in the chamber, and a driving device 5 is moved into engagement with the confined reel to rotate the latter in a direction to unwind the film. The sections 4*a*, 4*b* of the closed housing define a channel wherein the leader of the film advances in a direction toward the nip of two advancing rolls 11. The housing including the sections 4*a*, 4*b* has a window which enables the output element of the driving device 5 (such output element can include a friction wheel) to engage the outermost convolution of the film on the core of the confined reel 3 and/or one or both flanges of the reel in order to rotate the reel 3 in a counterclockwise direction (as seen in FIG. 1) whereby the leader of the film strikes a stripping projection of the section 4*a* and is compelled to enter the channel in order to advance toward the nip of the advancing rolls 11. The means for moving at least one of the sections 4*a*, 4*b* between open and closed positions can include one or more fluid-operated (e.g., penumatic) cylinder and piston units.

The leader of the film which is being paid out by the reel 3 in the chamber between the sections 4*a*, 4*b* advances past a first severing device and a pneumatically operated ejector 9. The advancing rolls 11 not only serve to move the film longitudinally toward and past a second ejector 12 and a second severing device 13 but also form part of a film length measuring device. The second severing device 13 is followed by a detector 14, e.g., a photoelectronic detector which generates signals in response to detection of leaders and trailing ends of successive films. The machine 1 further comprises a heat sealing or splicing device 17 which connects the trailing end of a web 22 (i.e., of the preceding exposed but undeveloped photographic roll film) with the leader of the next-following film. The splicing device 17 is located ahead of a second photoelectronic detector 18 which is followed by a brake 19, by a second pair of film advancing rolls 20 and by a variable-capacity magazine 21 for the web 22.

A duct 6 beneath the housing including the sections 4*a*, 4*b* has an open upper end to receive empty reels 3 in response to movement of one or both sections 4*a*, 4*b* to open position(s). The duct 6 directs spent (empty) reels 3 into a collecting receptacle, not shown. A motor 7 at a level beneath the advancing rolls 11 serves to transmit motion to the driving device 5, to the advancing rolls 11 and to a drive 15 for a strip of heat-sealable material which is used by the device 17 to splice the trailing end of the web 22 to the leader of a film. The path of movement of the strip of heat sealable material toward the splicing device 17 is monitored by a photoelectronic or other suitable detector 16. The motor 7 preferably further serves to drive the advancing rolls 20.

FIG. 1 further shows a source of convoluted band 10 which can be fed into the path for films in the nip of the advancing rolls 11 to take the place of one or more films under certain circumstances which will be explained hereinafter. A length of band 10 can be used to replace one or more photographic films in the web 22 which is to advance through the developing machine 2.

The strip of heat sealable material is delivered to the splicing device 17 in stepwise fashion in lengths which are needed to reliably bond the trailing end of the web 22 to the leader of the next-following photographic film. A severing device 116 is adjacent the splicing device 17 to sever the strip of heat sealable material in response to a signal from the detector 16. The splicing device 17 comprises a heated plunger which descends when the trailing end of the web 22, the leader of the next-following film and a freshly severed length of heat sealable material are in optimum positions relative to each other to form a splice by bonding the heat sealable material to the web as well as to the film. The splicing device 17 preferably comprises means for limiting the pressure of the heated plunger as well as the duration of contact between the plunger and heat sealable material in order to avoid damage to the photosensitive material.

The variable-capacity magazine 21 downstream of the second advancing rolls 20 includes a set of n fixedly mounted pulleys 21*c*, a set of n+1 movably mounted pulleys 21*d*, a pivotable carrier 21*e* for the pulleys 21*d*, a first switch 21*a* which is closed when the capacity of the magazine 21 is reduced to a minimum acceptable value (as a result of upward movement of pulleys 21*d* toward the pulleys 21*c*), and a second switch 21*b* which is closed when the capacity of the magazine 21 has been increased to a maximum value (i.e., when the pulleys 21*d* are located at a maximum distance from the pulleys 21*c*). The web 22 is alternately trained over the pulleys 21*c*, 21*d* to advance along a meandering path when the machines 1 and 2 are operative and the web is free to advance toward, into, through and beyond the first or foremost vessel or tank 29 of the developing machine.

Successive increments of the web 22 which advances toward and into the tank 29 pass over a guide roll 23. The tank 29 is followed by a second tank 30, the tank 30 is followed by a third tank 31, and the tank 31 is followed by a drying unit 32 carrying a takeup reel or spool 33 for the exposed and developed web 22. The tank 29 is assumed to contain a supply of developing solution, the tank 30 is assumed to contain a fixing and bleaching bath, and the tank 31 is assumed to contain a supply of water or another suitable rinsing fluid.

As a rule, it is important to ensure that the interval of treatment of each and every increment of the web 22 in the developing bath (tank 29) match a predetermined interval T. It is also desirable (but not as critical as in connection with the treatment in the tank 29) that the interval of treatment of each increment of the web 22 in the fixing bath (tank 30) match or closely approximate a predetermined interval. This enhances the quality of images on developed films which form the web 22. As concerns the treatment in the rinsing tank 31, it is merely important to ensure that each increment of the web 22 be rinsed for a predetermined minimum interval of time but the duration of treatment in the tank 31 can exceed such minimum interval without affecting the quality of developed films. The duration of treatment in the tank 31 can be multiple of the minimum interval of time without affecting the quality of the films.

The exact interval of treatment of each increment of the web 22 in the drying unit 32 is not critical, as long as such interval suffices to ensure adequate drying of the web prior to winding onto the core of the takeup reel 33 or prior to immediate introduction into a printer. Nevertheless, care should be exercised to avoid excessive drying of the web 22 in the unit 32. As a rule, the temperature in the drying unit 32 will be lowered if a certain length of the web 22 is to remain confined therein for an extensive period of time.

Figure 2:
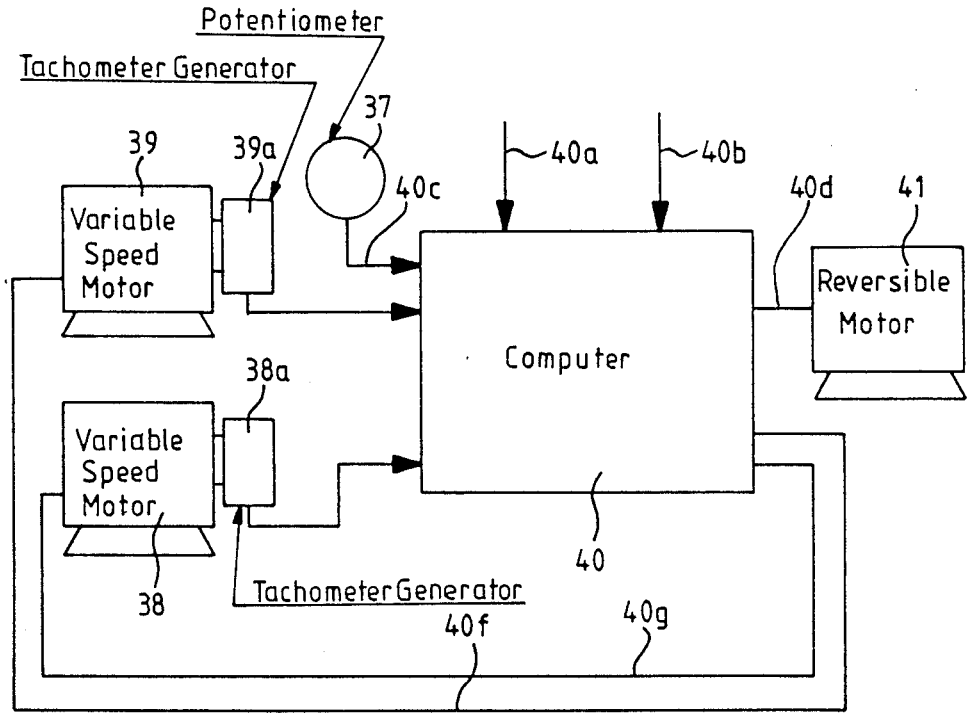
FIG. 2 is a diagrammatic view of the controls for the first and second film advancing means in the developing tank of the developing machine.

The inlet of the tank 29 is defined by the nip of two advancing rolls 24*a*, 24*b* which can be said to form part of a means for monitoring the speed of the web 22 at the locus of entry into the developing machine 2, i.e., into the tank 29. The drive means for the advancing rolls 24*a*, 24*b* (normally for one of these rolls) includes prime mover 38 (e.g., a variable-speed electric motor) which is shown in FIG. 2 and the speed of which is monitored by a signal generating device in the form of a tachometer generator 38*a*. The tachometer generator 38*a* transmits signals denoting the peripheral speed of the advancing rolls 24*a*, 24*b* to the corresponding input of a computer 40. The output 40*f* of the computer 40 transmits signals to a variable-speed prime mover 39 for a pair of film advancing rolls 25*a*, 25*b* at the outlet of the tank 29. The speed of the advancing rolls 25*a*, 25*b* is monitored by a second tachometer generator 39*a* which is mounted on the shaft of the prime mover 39 and transmits signals to the corresponding input of the computer 40.

The means for defining that (second) portion of the elongated path for the web 22 which extends through the tank 29 includes a first set of guide rolls 26 and a second set of guide rolls 27 mounted on a vertically movable carrier or support 28 at a level below the first set of guide rolls 26. The guide rolls 26 are rotatable in a fixedly mounted frame (not shown), and the carrier or support 28 for the guide rolls 27 is movable up and down by a reversible electric motor 41 (FIG. 2) which receives signals from the output 40*d* of the computer 40. The connection between the motor 41 and the carrier 28 can comprise at least two chains, cables, wires, ropes or analogous flexible elements 34 which can raise or lower the carrier 28 by moving it along suitable tracks (e.g., in the form of vertical rails or the like) in the interior of the tank 29. The upper ends of the flexible elements 34 are connected to winches 35 each of which carries a multiple-thread worm mating with a worm wheel on a common shaft 36. This ensures that both ends of the carrier 28 for the lower guide rolls 27 are raised or lowered to the same extent, i.e., that the orientation of the carrier 28 remains unchanged irrespective of its distance from the guide rolls 26 in the upper portion of the tank 29. The step-down ratio of the worm and worm wheel transmission including the worms of the winches 35 is preferably selected in such a way that a single revolution of the shaft 36 suffices to move the carrier 28 between its upper and lower end positions. The shaft 36 carries the movable part of a potentiometer 37 which constitutes a detector serving to monitor the lever of the carrier 28 and the set of guide rolls 27 in the tank 29. The potentiometer 37 transmits corresponding signals to the input 40*c* of the computer 40.

In accordance with a modification, the level of the carrier 28 is determined by a directly connected motor. This renders it necessary to dispense with a self-locking step-down transmission, i.e., the aforementioned worm and worm wheel drives can be replaced with bevel gear transmissions and the motor 41 is then used to move the carrier 28 up or down by way of such bevel gear transmissions. Moreover, the level indicating detector is then connected with the carrier 28 by way of a suitable step-down transmission, i.e., it cannot be mounted directly on the shaft 36.

The inlet of the second tank 30 is defined by a guide roll 24A which need not be driven; it merely serves to direct the web 22 into the body of liquid in the tank 30. The reason is that the speed of successive increments of the web 22 which enter the tank 30 is determined by the advancing rolls 25*a*, 25*b*. The advancing rolls 25*a'*, 25*b'* at the outlet of the tank 30 are driven in the same way as the advancing rolls 25*a*, 25*b* at the outlet of the tank 29, namely at a speed which is a function of the monitored speed of advancing rolls 25*a*, 25*b*. In all other respects, the means for regulating the transport of successive increments of the web 22 through the tank 30 is the same as described with reference to the tank 29, i.e., the tank 30 also contains a carrier 28 for a lower set of guide rolls 27 which are movable up and down to shorten or lengthen the path portion in the tank in dependency on the speed of longitudinal movement of the web 22 on its way from the tank 29 toward the tank 31. The provision of means for regulating the length of intervals of treatment of successive increments of the web 22 in the fixing bath is particularly desirable if the takeup reel 33 is omitted or is not in use, i.e., if the drying unit 32 admits the web 22 directly into a printing or copying machine.

The diagram of FIG. 2 shows the elements of the means for regulating the speed of the web 22 in the developing machine 2 in such a way that eventual variations of speed of the web at the inlet of the first tank 29 cannot adversely influence the development of films which form the web 22. The computer 40 has an input 40*a* for signals which are transmitted by the machine 1 in response to detection of malfunctions, for example, in response to detected malfunctioning (e.g., prolonged idleness) of the splicing device 17. Another input 40*b* of the computer 40 receives signals in response to closing of the switch 21*a*, i.e., when the supply of web 22 in the magazine 21 has been reduced to a minimum acceptable value. The input 40*c* transmits signals from the level monitoring detector 37, i.e., it indicates the level of the carrier 28 in the tank 29 and hence the length of that portion of the path for the web 22 which extends through the developing solution in the tank 29. The output 41*d* of the computer 40 transmits signals to the motor 41 which adjusts the level of the carrier 28 in the tank 29, the output 40*f* of the computer 40 transmits signals to the prime mover 39 for the advancing rolls 25*a*, 25*b*, and a further output 40*g* of the computer 40 transmits signals to the prime mover 38 for the advancing rolls 24*a*, 24*b*.

The mode of operation of the combination of machines 1 and 2 is as follows:

A reel 3 which carries a roll of convoluted exposed customer film is removed from its cartridge (e.g., in a manner as disclosed in aforementioned U.S. Pat. Nos. 4,621,970 and 4,732,278) and is placed between the sections 4*a*, 4*b* in the machine 1 while at least one of these sections assumes an open position. The housing including the sections 4*a*, 4*b* is then closed and the motor 7 is caused to rotate the driving device 5 which rotates the reel 3 between the sections 4*a*, 4*b* in a direction to direct the leader of the film into the aforementioned channel which is defined by the sections 4a, 4b and serves to direct the leader of the film toward and beyond the first severing unit 8, first ejector 9, film advancing and length measuring rolls 11, second ejector 12 and second severing device 13 into the range of the photoelectronic detector 14. A signal from the detector 14 results in stoppage of the motor 7 or in disengagement of the driving device 5 from the motor 7 so that the film which has been advanced from the reel 3 comes to a halt. Furthermore, the detector 14 causes the severing device 13 to trim the leader of the film. In the next step, the motor 7 causes the advancing device 11 to move the trimmed leader of the film all the way to the center of the splicing device 17 so that the trimmed leader is adjacent or actually abuts the trimmed trailing end of the web 22, i.e., the trimmed trailing end of the preceding customer film. The trimming device 17 is actuated when the forward movement of the film is completed so that the trimmed leader of the film is spliced to the trailing end of the web 22. The splicing operation involves the application of a uniting band of heat sealable material which is severed by the device 116 and is bonded to the leader of the film as well as to the trailing end of the web 22. In the next step, the advancing device 20 is set in motion to transport the film into the magazine 21 while the rolls 24a, 24b advance the web 22 from the magazine 21 into that portion of the elongated path which extends through the body of liquid in the tank 29. As a rule, the rolls 24a, 24b advance the web 22 at a constant speed.

The housing including the sections 4a, 4b opens automatically, for example, in response to increased tension of the film when the unwinding of film from the reel 3 is completed, and the advancing rolls 11 and/or 20 then cause the reel 3 to leave the opened housing and to advance toward the severing unit 8 which is actuated to sever the trailing end of the film from the core of the reel 3. The thus separated reel 3 is free to enter the aforementioned collecting receptacle by descending in the duct 6. The trailing end of the film is advanced into the range of the detector 14 which transmits a signal serving to arrest the film with a delay which is necessary to advance the trailing end to the center of the splicing device 17 so that such trailing end is in an optimum position for splicing to the leader of the next-following film. The brake 19 is applied when the trailing end of the film (actually the trailing end of the web 22) reaches the center of the splicing device 17 to thus ensure that the position of the trailing end of the web remains unchanged until after completion of the next splicing operation. This guarantees that a pull upon the web 22 in the magazine 21 cannot dislodge the trailing end of the web at the splicing station.

The housing including the sections 4a, 4b then receives a fresh reel and the unwinding, trimming and positioning of the film which surrounds the core of the fresh reel is carried out in the aforedescribed manner.

The advancing rolls 24a, 24b advance the web 22 into the first tank 29 of the developing machine 2 at a speed which corresponds to average speed of advancement of films through the machine 1, e.g., in meters per minute. The advancing rolls 24a, 24b are driven by the prime mover 38 in response to signals from the output 40g of the computer 40. As a rule, the rolls 11 and 20 transport the films at a relatively high speed, i.e., the period of dwell of a film in the machine 1 is relatively long only because the introduction of the leader of a film into the path portion which is defined by the machine 1 and the step of splicing the leader of a film in the splicing device 17 take up relatively long intervals of time. Therefore, the rate of admission of web 22 into the magazine 21 is not uniform but fluctuates within a wide range. As a rule, the capacity of the magazine 21 is selected in such a way that it can compensate for fluctuations in the rate of admission of two or more successive films.

The splicing operation can take up a relatively long period of time for a number of reasons. For example, the machine 1 normally embodies a detector which monitors the films for the quality of their perforations, and detector means for monitoring the film between the sections 4a, 4b and the splicing device 17 in order to ascertain whether or not the proper side of the film faces the plunger of the splicing device. If the perforations of a film in the machine 1 are damaged, an operator can attend to the problem by reaching the film through a suitable light excluding device (reference may be had to commonly owned U.S. Pat. No. 4,799,076 granted Jan. 17, 1989) which enables one or both hands to reach the film in the otherwise encapsulated machine 1 to repair the damage or to insert the film having defective perforations into a suitable cartridge which is removed from the machine 1 for development in a specially designed developing machine or for reintroduction into the machine 1. A film which has a wrong side facing the plunger of the splicing device 17 is also removed from the machine 1 in the just described manner for rewinding onto another reel and for reintroduction into the housing including the sections 4a and 4b. Such manual handling of certain films in the machine 1 can take up relatively long periods of time, and the magazine 21 is preferably designed to store a certain length of the web 22 so that the developing machine 2 need not be brought to a standstill while an operator removes a film from the machine 1 or attempts to eliminate the problem without actually removing the film from the light-tight enclosure of the machine 1.

Figure 4:
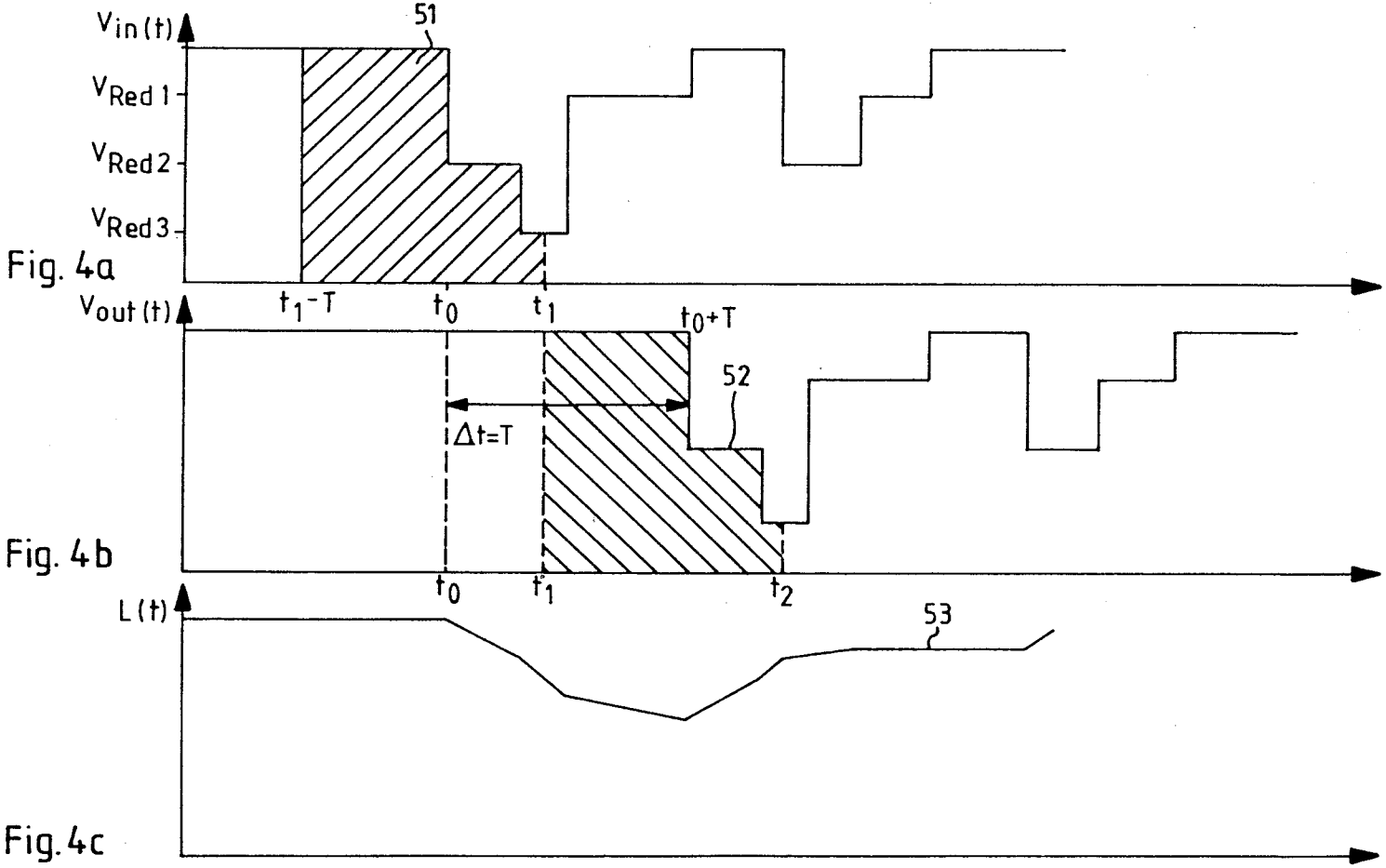
FIG. 4*a* is a velocity diagram of the first advancing means in the developing machine.
FIG. 4*b* is a velocity diagram of the second advancing means in the developing machine.
FIG. 4*c* is a diagram showing changes of length of the web in a tank of the developing machine in response to changes of the rate of admission of the web into the tank.

If the interruption of automatic processing of films in the machine 1 is relatively long, even a large or very large magazine 21 would be incapable of storing a sufficient length of web 22 in order to avoid any deceleration of the rolls 24a, 24b at the inlet of the first tank 29 in the developing machine 2. A signal which is indicative of a relatively long interruption of automatic operation of the machine 1 is transmitted to the input 40a of the computer 40 which reduces the speed of the prime mover 38 by transmitting an appropriate signal via output 40g. The speed of the prime mover 38 for the advancing rolls 24a, 24b is reduced while the length of the web 22 in the magazine 21 decreases as a result of advancement of the web into and beyond the nip of the rolls 24a, 24b. The curve 51 in the diagram of FIG. 4a illustrates one mode of varying the speed V of the rolls 24a, 24b in response to signals which indicate to the computer 40 that the speed of the web 22 during travel through the tank 29 is to be reduced. The diagram of FIG. 4a further shows that the speed of the prime mover 38 can be reduced stepwise, namely from a standard or average speed $V_{in}(t)$ to a first reduced speed $V_{Red}1$, to a second reduced speed $V_{Red}2$ or to a third reduced speed $V_{Red}3$. The arrangement may be such that $V_{Red}1$ equals half $V_{in}t$, and $V_{Red}2$ equals half $V_{Red}1$.

For example, a signal from the machine 1 via input 40a can result in immediate reduction of the speed of rolls 24a, 24b from $V_{in}t$ to $V_{Red}1$. If the signal at the input 40a persists for a certain interval of time, this indicates that the removal of a film from the enclosure of the machine 1 takes longer than expected; the computer 40 then reduces the speed of the rolls 24*a*, 24*b* from $V_{Red}1$ to $V_{Red}2$ while the length of the web 2 in the magazine 21 continues to decrease. If a reduction of the speed to $V_{Red}2$ does not suffice to complete the removal of a film from the machine 1 prior to maximum permissible exhaustion of the supply of web 22 in the magazine 21, the computer 40 reduces the speed of the advancing rolls 24*a*, 24*b* to $V_{Red}3$.

If the speed of advancing rolls 24*a*, 24*b* is reduced below $V_{in}(t)$ while the speed of the advancing rolls 25*a*, 25*b* remains unchanged, the length L of the web 22 in the tank 29 decreases in a manner as indicated by the curve 53 in the diagram of FIG. 4*c*. Thus, the carrier 28 rises with the respective set of guide rolls 27 and the length cf the path portion in the body of liquid in the tank 29 is reduced accordingly.

In the absence of any regulation of the speed of advancing rolls 25*a*, 25*b* in response to a change of speed of the rolls 24*a*, 24*b* and a change of the level of the carrier 28, the length of intervals T of treatment of successive increments of the web 22 in the tank 29 would depart from the optimum length so that the quality of exposed films would be affected irrespective of whether the intervals of treatment are too short or too long. It has been found, and this can be readily confirmed by a simple calculation, that the intervals T of treatment of successive increments of the web 22 in the tank 29 match the desired optimum intervals if the speed $V_{out}(t)$ of the advancing rolls 25*a*, 25*b* is varied in the same way as the speed of the advancing rolls 24*a*, 24*b* (compare the curve 51 of FIG. 4*a* with the curve 52 of FIG. 4*b*) and each change of speed of the advancing rolls 24*a*, 24*b* is followed by an identical change of speed of the advancing rolls 25*a*, 25*b* with a delay which matches the interval T. This holds true for a deceleration as well as for an acceleration of the advancing rolls 24*a*, 24*b* and 25*a*, 25*b*. Rapid acceleration of the advancing rolls 24*a*, 24*b* back to the speed $V_{in}(t)$ will take place when the removal of a defective or improperly oriented film from the machine 1 is completed so that the signal at the input 40*a* of the computer 40 disappears. Such rapid acceleration of advancing rolls 24*a*, 24*b* entails an equally rapid acceleration of the advancing rolls 25*a*, 25*b* but with a delay corresponding to the interval T, i.e., corresponding to the interval of optimum treatment of each increment of the web 22 in the tank 29.

Starting from a mode of operation when the prime mover 38 drives the advancing rolls 24*a*, 24*b* at the maximum speed $V_{in}(t)$ and the prime mover 39 drives the advancing rolls 25*a*, 25*b* at the maximum speed $V_{out}(t)$, any reduction of the speed of advancing rolls 24*a*, 24*b* and 25*a*, 25*b* necessitates a shortening of the length L of web in the tank 29 in a manner as indicated by the curve 53 of FIG. 4*c*. The length of the web portion in the tank 29 can be ascertained on the basis of the equation $$L(t_1) = \int_{t_1 - T}^{t_1} V_{in}(t)\, dt.$$

Thus, the output 40*d* of the computer 40 transmits to the motor 41 signals whose characteristics vary in accordance with the above equation in response to changes of the speed of advancing rolls 24*a*, 24*b* whereby the motor 41 raises or lowers the carrier 28 for the guide rolls 27 in the tank 29.

It can happen that, after long periods of use, the speed of transport of the web 22 through the tank 29 does not exactly match the peripheral speed of the advancing rolls 24*a*, 24*b*. This can take place as a result of slippage of peripheral surfaces of advancing rolls 24*a*, 24*b* with reference to the web 22 and can result in departure of intervals of treatment of successive increments of the web 22 in the developing solution from optimum values. The provision of the motor 41 eliminates the likelihood of such departure from optimum intervals of treatment because the motor 41 receives from the computer 40 signals via output 40*d* and invariably ensures that the position or level of the carrier 28 in the tank 29 conforms to the terms of the above equation. This motor 41 could be omitted in the absence of any slippage of the web 22 relative to the advancing rolls 24*a*, 24*b* and/or 25*a*, 25*b* because the web 22 in the tank 29 could automatically regulate the level of the carrier 28 by raising the carrier when the speed of advancing rolls 25*a*, 25*b* exceeds the speed of advancing rolls 24*a*, 24*b* and by permitting the carrier 28 and its guide rolls 27 to descend in the tank 29 by gravity when the speed of advancing rolls 24*a*, 24*b* exceeds the speed of advancing rolls 25*a*, 25*b*.

Transmission of appropriate signals from the computer 40 to the motor 41 via output 40*d* necessitates the utilization of a relatively sophisticated computer if the computer is designed to continuously process the signals from the tachometer generator 38*a* in order to generate signals which are transmitted via output 40*d* and control the operation of the motor 41, i e., the level of the carrier 28 in the tank 29. In order to avoid the need for a highly complex computer, the speed of advancing rolls 24*a*, 24*b* is preferably variable between a limited number of values (i.e., from normal or maximum speed $V_{in}(t)$ to any one of three reduced speeds in a manner as shown in FIG. 4*a*). However, it is within the purview of the invention to replace the prime movers 38 and 39 with prime movers each of which can drive the respective pair of advancing rolls at any one of a practically infinite number of different speeds. The arrangement may be such that the level of the carrier 28 in the tank 29 is changed after elapse of successive intervals T.

The developing machine 2 is preferably equipped with means for preventing a tensioning of the web 22 beyond its breaking or tearing strength. The motor 41 constitutes one form of such means in that it automatically adjusts the level of the carrier 28 in the tank 29 so that the web 22 in this tank is not subjected to excessive tensional stresses which could result in breakage or opening of the splices or in tearing of the web between the splices. In the absence of the motor 41, the application of excessive tensional stresses to the web 22 can be prevented by installing friction clutches between the advancing rolls 25*a*, 25*b* and the motor 39 so that the output element of the motor 39 would slip relative to the rolls 25*a*, 25*b* when these rolls would encounter a predetermined maximum permissible resistance to transport the web into the tank 30. Alternatively, the computer 40 can control the speed $V_{out}(t)$ of the advancing rolls 25*a*, 25*b* (via prime mover 39) in such a way that this speed could not reach a value at which the tensional stress upon the web 22 would suffice to result in breaking of or other damage to the web.

The carrier 28 can be omitted with the motor 41 if the guide rolls 27 are mounted in the tank 29 for movement toward or away from the guide rolls 26 along stationary upright rails or like guide elements. Excessive tensioning of the web 22 in the tank 29 is then prevented by the provision of aforementioned friction clutches between the output element of the prime mover 39 and the advancing rolls 25*a*, 25*b*.

The intervals of treatment of successive increments of the web 22 in the second tank 30 of the developing machine 2 can be regulated in the same way as described with reference to the tank 29. However, a regulation of the transport of web 22 through the tank 30 is simpler because there is no need for a second prime mover 38. This is due to the fact that the speed at which the web 22 enters the tank 30 is the same as the speed at which the advancing rolls 25*a*, 25*b* transport the web out the first tank 29. In all other respects, the regulation of advancement of the web 22 through the tank 30 is the same as the regulation of advancement through the tank 29. The intervals T of treatment in the tank 30 may but need not be exactly the same as the intervals of optimum treatment of successive increments of the web 22 in the tank 29. The controls for the driven advancing rolls 25*a*', 25*b*' at the outlet of the tank 30 and for the carrier 28 in the tank 30 include a second computer which is not shown in the drawing. The tanks 29, 30 are or can be immediately or closely adjacent each other.

The length of the rinsing tank 31 is normally twice the length of the tank 29 or 30. The transport of successive increments of the web 22 through the tank 31 can be regulated in the same way as described above in connection with the tank 29. Such regulation is not absolutely necessary but might be desirable and advantageous in order to ensure that the tank 31 can serve as a buffer for storage of a certain length of developed and fixed web 22.

Not only the tank 31 but also the drying unit 32 can be designed in such a way that each of these components can store a substantial length of the web 22. In other words, the capacity of the tank 31 can exceed that capacity which is necessary for proper rinsing of the web 22, and the capacity of the drying unit 32 can exceed that capacity which is required for proper drying of the web prior to winding onto the core of the takeup reel 33 or prior to admission of the web directly into a printer. Such spare capacity of the tank 31 and drying unit 32 is utilized only under certain circumstances, i.e., not necessarily during normal operation of the production line including the machines 1 and 2. The reason for the provision of a tank 31 having a greater than required minimum capacity and of a drying unit 32 having a greater than required minimum capacity is that this renders it possible to store a substantial length of developed and fixed web (in the tank 31) and a substantial length of rinsed and dried web (in the unit 32) ahead of the next-following machine of the production line, such as the aforementioned printer. This ensures that the next-following machine can draw a considerable length of the web from the drying unit 32 even at a time when the advancing rolls 24*a*, 24*b* in the tank 29 are driven at the minimum speed $V_{Red}3$. Moreover, a relatively large drying unit 32 can store a considerable length of the web 22 when the next-following machine is at a standstill but the machine 1 continues to make the web 22 by splicing successive customer films to the trailing end of the growing web 22. In other words, the utilization of a large tank 31 and a large drying unit 32 renders it possible to compensate for relatively short or even longer interruptions of advancement of the web 22 beyond the developing machine 2, e.g., due to a malfunction of the next-following machine. The exact construction of the tank 31 and/or drying unit 32 forms no part of the present invention. Reference may be had to numerous United States and foreign patents of the assignee of the present application.

An advantage of the improved method and of the improved combination of machines is that one or more developing machines can be directly coupled to the preceding and next-following machines without affecting the quality of the developing operation and without the need for bulky and expensive magazines between the developing machines and the preceding machines. This is accomplished by the simple expedient of varying the speed of advancing rolls (such as 25*a*, 25*b*) at the downstream end of each such path portion (e.g., in 29) wherein each increment of the web must be treated for a predetermined interval of time as a function of changes of the speed of advancing rolls (such as 24*a*, 24*b*) at the upstream end of such path portion and by changing the length L of the web between the two sets of advancing rolls simultaneously with changes of the speed of advancing rolls at the outlet end.

Furthermore, the improved method and the improved combination of machines ensure that the machine which follows a developing machine net not be stopped even if the machine which precedes the developing machine is brought to a standstill or delivers the web at a plurality of different speeds. The insertion of a length of flexible strip material 10 will take place when this becomes desirable in order to prevent damage to the non-replaceable customer films. Thus, a length of the strip 10 will be introduced into the developing machine (particularly into the fixing and/or developing tank of such machine) when the developing machine is to be brought to a standstill. This ensures that the web 22 is not interrupted but the web portion in the fixing and/or developing tank is not a customer film which could be damaged as a result of excessive exposure to the action of a developing or fixing bath but rather a length of the strip 10 which is not affected by the developing and/or fixing bath and, if affected, can be simply discarded after it has served its purpose. As mentioned above, photographic films can remain in the rinsing tank and/or in the drying unit of a developing machine for longer intervals of time without any damage thereto. Thus, if a length of strip 10 is used, such strip is relatively short since it must extend only through the fixing and/or developing tank of the developing machine which has been brought to a standstill.

It goes without saying that the computer 40 embodies a suitable memory which can store signals from the tachometer generator 38*a* for intervals $\Delta t = T$ for delayed regulation of the speed of advancing rolls 25*a*, 25*b* in a manner as described with reference to FIGS. 4*a* and 4*b*.

Figure 3:
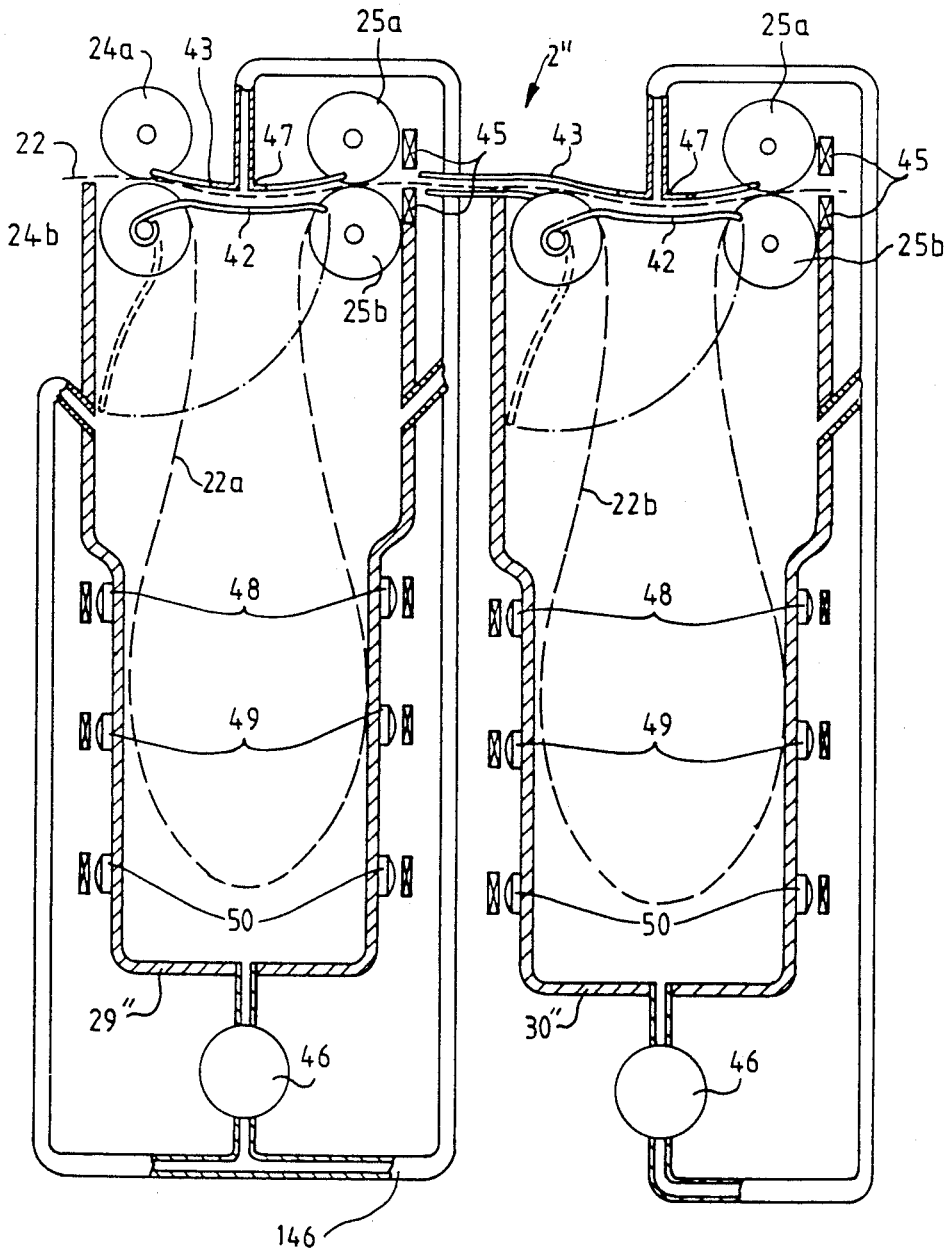
FIG. 3 is a partly elevational and partly vertical sectional view of a portion of a modified developing machine.

FIG. 3 shows the first two tanks 29", 30" of a modified developing machine 2". This machine operates without carriers 28, i.e., the web 22 which advances through the tank 29" is caused to form a first loop 22*a* (indicated by broken lines) and the web 22 which advances through the second tank 30" is caused to form a second loop 22*b* (also indicated by broken lines). The developing machine 2" of FIG. 3 comprises web guiding elements 42 and 43 which extend between the advancing rolls 24*a*, 24*b* and 25*a*, 25*b* in order to direct the leader of a fresly introduced web 22 into the nip of the advancing rolls 25*a*, 25. The leader is detected by a photoelectronic detector 45 which is located downstream of the advancing rolls 25*a*, 25*b*, and the signal from the detector 45 is used to move the web guiding element 42 from the solid-line (operative) position to the broken-line (inoperative) position of FIG. 3. At the same time, the signal from the detector 45 initiates the operation of a pump 46 which circulates a stream of developing solution through a conduit 146 and to one or more orifices 47 in the web guiding element 43 so that the stream of developing solution promotes the formation of the loop 22*a* by impinging upon the web 22 behind the nip of the rolls 25*a*, 25*b*. The detector 45 operates with a radiation source which emits non-actinic light or any other form of radiation which does not affect the quality of images on the web 22.

The tank 29″ is made at least in part of a radiation-transmitting material and carries several (e.g., three) photoelectronic detectors 48, 49, 50 at different levels. These detectors transmit signals when they detect the bight of the loop 22*a* at the respective level in the tank 29″. The entire tank 29″ need not be made of a radiation-transmitting material, as long as it can transmit radiation from the radiation sources of the detectors 48–50 to the respective transducers which transmit signals to the prime mover means for the advancing rolls 25*a*, 25*b*. The pump 46 further serves to circulate developing solution in the entire tank 29″; to this end, the tank 29″ has an outlet at the bottom to admit developing solution to the suction intake of the pump 46 and several lateral inlets which receive developing solution from the outlet of the pump.

The leader of a fresh web 22 can be advanced through the nip of the advancing rolls 24*a*, 24*b*, between the web guiding elements 42, 43 (the element 42 then assumes the operative position which is shown by solid lines), through the nip of the advancing rolls 25*a*, 25*b* and into the range of the detector 45. The latter generates a signal which initiates a movement of the web guiding element 42 to its inoperative position (e.g., by actuating a pneumatic or other suitable motor serving as a means for pivoting the element 42 between its operative and inoperative positions), and such signal further initiates stoppage of the prime mover (such as the prime mover 39 of FIG. 2) for the advancing rolls 25*a*, 25*b*. The prime mover (such as the prime mover 38 of FIG. 2) continues to drive the advancing rolls 24*a* so that the web 22 forms the loop 22*a*. Such formation of the loop 22*a* is assisted by the stream or streams of developing solution issuing from the orifice or orifices 47 of the upper web guiding element 43. The prime mover 39 for the advancing rolls 25*a*, 25*b* is started at a different speed by each of the detectors 48, 49 or 50, depending upon the required length of the loop 22*a*, i.e., on the required interval of treatment of successive increments of the web 22 in the tank 29″. The rolls 25*a*, 25*b* then advance the leader of the web 22 into the nip of advancing rolls 25*a*, 25*b* in the tank 30″ and into the range of the adjacent detector 45 which initiates a movement of the respective web guiding element 42 (in the tank 30″) to its inoperative position and starts the respective pump 46 in the same way as described above in connection with the tank 29″.

The level of each of the three detectors 48–50 in the tank 29″ corresponds to one of three reduced speeds of the advancing rolls 25*a*, 25*b* as shown in the diagram of FIG. 4*a* for the rolls 24*a*, 24*b*. The lowermost detector 50 initiates rotation of the rolls 25*a*, 25*b* at a maximum speed. If the speed of advancing rolls 24*a*, 24*b* is reduced and the side of the loop 22*a* decreases so that its bight is located at the level of the detector 48, this does not immediately entail a reduction of the speed of advancing rolls 25*a*, 25*b* but only after elapse of the interval T for reasons which were described in connection with the diagrams of FIGS. 4*a* and 4*b*. When the speed of advancing rolls 24*a*, 24*b* again matches the speed of advancing rolls 25*a*, 25*b*, the size of the loop 22*a* is constant and the speed of advancing rolls 25*a*, 25*b* is controlled by the detector 48.

Figure 5:
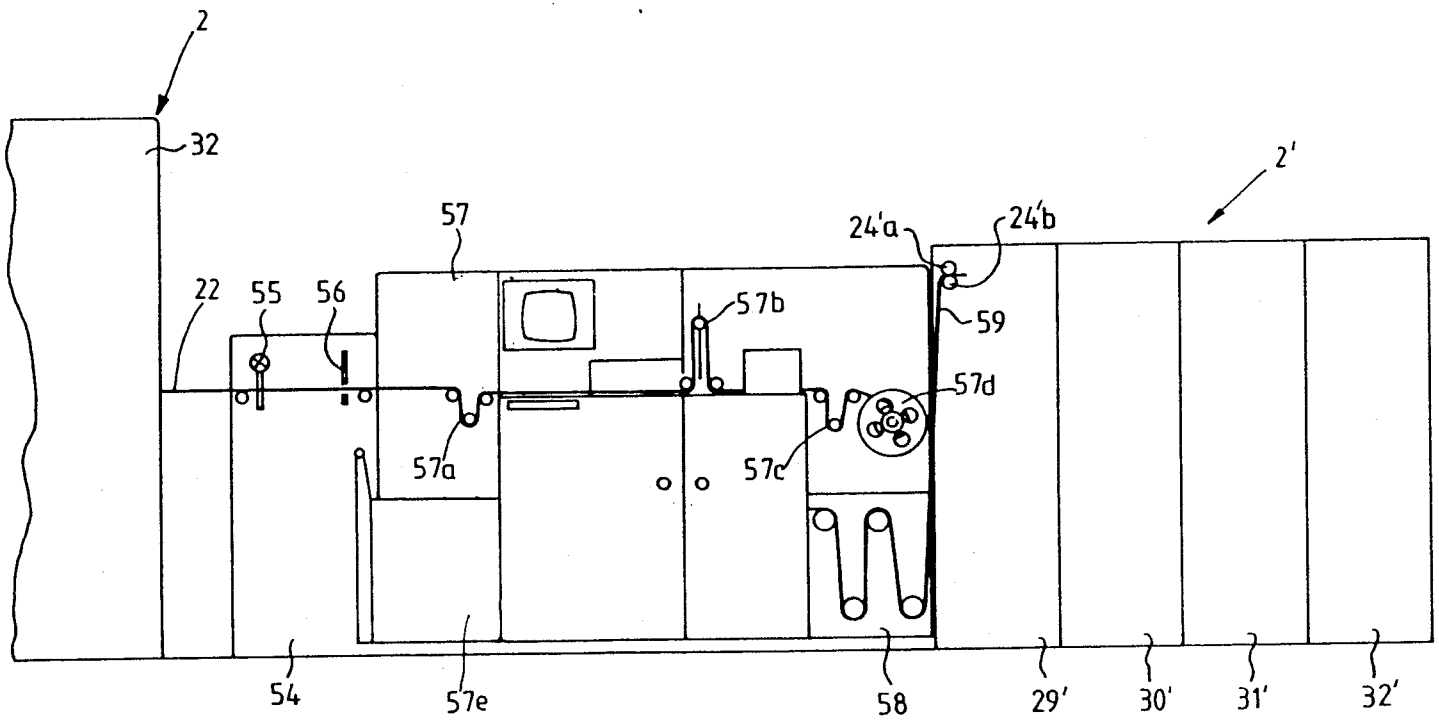
FIG. 5 is a schematic elevational view of a combination of the developing machine of FIG. 1 or 3 with a notching machine, a printer and a developing machine for photographic paper.

FIG. 5 shows a combination of the developing machine 2 (only the drying unit 32 of this machine is shown) with a roll copying machine or printer 57 and a second developing machine 2′ for a web 59 of exposed photographic paper. The combination of machines which is shown in FIG. 5 further includes a film notching machine 54 which is installed between the developing machine 2 and the printer 57 and has means for providing the exposed and developed web 22 with notches or similar indicia to facilitate proper positioning of successive film frames in the printer 57 and predictable subdivision of each customer film into sections of desired length.

The web 22 advances from the drying unit 32 of the machine 2 through the notching machine 54 and into the printer 57 along a straight portion of its path. The machine 54 includes a photoelectronic detector 55 of film frames and/or frame lines and controls the operation of a notching or indicia forming tool 56 of conventional design.

The printer 57 is also of conventional design and serves to image the film frames of the web 22 onto the web 59 of photographic paper which is thereupon developed in the machine 2′ prior to being subdivided into discrete prints. The illustrated printer 57 has a loop former 57*a* ahead of the printing or copying station. The purpose of the loop former 57*a* is to store a certain length of the web 22 ahead of the copying station in order to compensate for eventual fluctuations in the rate of delivery of web 22 from the drying unit 32 of the machine 2 and nothing machine 54. The loop former 57*a* is followed by a locating device for film frames, a detector, a loop former 57*b* and the copying station. The latter is followed by a further loop former 57*c* and a winding station where the web 22 is collected on the core of a reel 57*d*.

The lower left-hand portion 57*e* of the printer 57 accommodates a relatively large supply of a web 59 of photographic paper, e.g., in the form of a standard cassette. On its way from the cassette toward the copying machine 2′, the web 59 of photographic paper advances through a relatively small variable capacity magazine 58 which can compensate for minor fluctuations in the rate of advancement of the web 59 into the machine 2′. The web 59 thereupon advances toward the advancing rolls 24*a*′, 24*b*′ in the first tank 29′ of the developing machine 2′. This machine further comprises a fixing tank 30′, a rinsing tank 31′ and a drying unit 32′. The transport of web 59 through the tank 31′ and/or 30′ and/or 29′ of the machine 2′ can be regulated in the same way as described in connection with FIGS. 1, 2, 4*a*, 4*b* and 4*c* or as described with reference to FIG. 3, depending upon the selected design of the machine 2′. It goes without saying that the path for photographic paper from the cassette in the lower left-hand corner 57*e* of the machine 57 to the copying station, thence to the magazine 58 and ultimately to the advancing rolls 24a', 24b' is sealed against penetration of light.

The main difference between the machine 2' and a machine 2 for the development of webs 22 is that the machine 2' has longer advancing, guiding and other rolls because the width of the web 59 exceeds the width of the web 22.

Since the rate of advancement of the web 59 through the printer 57 can fluctuate for any one of a number of different reasons, the transport of this web through the developing machine 2' is regulated in the same way as the transport of web 22 through the developing machine 2, i.e., the machine 2' ensures that each increment of the web 59 remains in the tank 29' (and if desired or necessary also in the tank 31' and/or 30') for an interval of time which is best suited to ensure an optimum treatment in the respective bath. As a rule, the rate of delivery of web 59 from the machine 57 into the machine 2' will fluctuate due to the need for replacement of empty cassettes with loaded cassettes containing a supply of photographic paper.

It is further within the purview of the invention to include into the combination of a further machine which receives the web 59 from the developing machine 2' and includes means for subdividing the web 59 into discrete prints, for subdividing the web 22 into discrete roll films or into sections of roll films, and for inserting the prints and the corresponding films or sections of films into the pockets of customer envelopes which are ready to be shipped or delivered to dealers or directly to customers. A machine of such character is disclosed in commonly owned U.S. Pat. No. 4,154,046 granted May 15, 1979 to Weber et al.

The tank 31' and the drying unit 32' can be designed to store substantial lengths of exposed and developed web 59 so that they can gather such web while the next-following machine is idle or operates at less than standard or normal speed. Thus, the machine 2' can serve as a buffer between the printer 57 and the aforediscussed machine which divides the web 59 into discrete prints and divides the web 22 into discrete films or into discrete sections of films. The machine 2' can perform such function without affecting the quality of treatment of the web 59, particularly in the tank 30' and/or 29'.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. A method of advancing a running web of photographic material in a predetermined direction along an elongated path having a first portion extending through a first machine from which successive increments of the web are discharged, at least at times, at different speeds and a second portion extending through a developing machine in at least one part of which each increment of the web should undergo treatment for a predetermined interval of time, comprising the steps of monitoring the speed of the web at the upstream end of the second portion of said path; and varying the speed of the web at the downstream end of the second portion of said path in response to detected changes of the speed of the web at the upstream end so that each increment of the web remains in the second portion of said path for said predetermined interval of time.

2. The method of claim 1, further comprising the step of varying the length of the second portion of said path simultaneously with said speed varying step.

3. The method of claim 1 of advancing a running web of photographic material through a developing machine in a second part of which each increment of the web advances along a third portion of said path and should undergo treatment for a preselected interval of time following treatment in said at least one part, further comprising the step of varying the speed of the web at the downstream end of the third portion of said path in response to changes of speed of the web at the downstream end of the second portion of said path so that each increment of the web remains in the third portion of said path for said preselected interval of time.

4. The method of claim 3, further comprising the step of varying the length of the third portion of said path simultaneously with said step of varying the speed of the web at the downstream end of the third portion of said path.

5. The method of claim 3, wherein the at least one part of the developing machine includes a developing bath and the second part of the developing machine includes a fixing bath.

6. The method of claim 1, wherein said speed varying step includes conforming the speed of the web at the downstream end of the second portion of said path to the speed of the web at the upstream end.

7. The method of claim 6, wherein said speed varying step further includes delaying said speed conforming step for each increment of the web by said predetermined interval following detection of the speed of successive increments of the web at the upstream end of the second portion of said path.

8. The method of claim 6, wherein the speed of the web at the upstream end of the second portion of said path varies stepwise, and further comprising the step of monitoring the length of the web in the second portion of said path.

9. The method of claim 1, further comprising the step of monitoring the length of the web in the second portion of said path.

10. A combination of machines for processing at least one running web of photographic material, including a first machine defining for the web a first portion of an elongated path and comprising means for discharging the web, at least at times, at different speeds; and a developing machine including at least one part defining a second portion of said path downstream of said first portion and arranged to subject successive increments of the web to a treatment which should last for a predetermined interval of time, means for monitoring the speed of the web at the upstream end of the second portion of said path, and means for varying the speed of the web at the downstream end of the second portion of said path in response to detected changes of speed at the upstream end so that each increment of the web remains in the second portion of said path for said predetermined interval of time.

11. The combination of claim 10, wherein said monitoring means includes means for generating signals denoting the length of the web in said at least one part of said developing machine.

12. The combination of claim 10, wherein said monitoring means includes first variable-speed web advancing means and means for generating signals denoting the speed of said first advancing means, said speed varying means including second variable-speed web advancing means and means for driving said second advancing means at a speed which is a function of said signals.

13. The combination of claim 12, wherein said driving means includes a prime mover for said second advancing means and means for regulating the speed of said prime mover as a function of said signals, said regulating means including a computer with input means connected to said signal generating means and output means connected to said prime mover.

14. The combination of claim 13, wherein said computer comprises a memory for said signals and is operative to vary the speed of said second advancing means so as to conform to the speed of said first advancing means with a delay corresponding to said predetermined interval of time.

15. The combination of claim 14, wherein said monitoring means further comprises additional prime mover means operative to drive said first advancing means at a limited number of different speeds.

16. The combination of claim 15, further comprising adjusting means for varying the length of the second portion of said path as a function of said signals so as to lengthen the second portion in response to increasing speed cf the first advancing means and vice versa.

17. The combination of claim 16, wherein said adjusting means comprises a first set of guide rolls for the web in said at least one part of said developing machine, a second set of guide rolls for the web, in said at least one part, and means for moving at least one set of guide rolls relative to the other set.

18. The combination of claim 17, wherein said at least one part includes a developing tank, said other set being disposed in said tank at a level above said at least one set and said moving means including carrier means for moving said at least one set up and down nearer to and further away from said other set.

19. The combination of claim 18, further comprising signal generating means for monitoring the level of said at least one set, said carrier means being responsive to signals from said level monitoring means.

20. The combination of claim 16, wherein said computer comprises additional output means for transmission of signals to said adjusting means in accordance with the equation $$L(t_1) = \int_{t_1 - T}^{t_1} V_{in}(t)\, dt,$$

wherein $V_{in}(t)$ is the speed of the web at the upstream end of the second portion of said path, L is the length of the second portion, and T is said predetermined interval of time.

21. The combination of claim 12, wherein said second advancing means includes means for applying to the web a pull which is below the breaking strength of the web.

22. The combination of claim 12, further comprising adjusting means for varying the length of said second portion of said path, including means for directing at least one fluid stream against the web intermediate said first and second advancing means, signal generating detector means for monitoring the length of said second portion of said path, and means for regulating the operation of said directing means as a function of said signals.

23. The combination of claim 22, wherein said detector means includes at least one photoelectronic detector including a source of non-actinic radiation.

24. The combination of claim 22, further comprising means for guiding the leader of the web from said first to said second advancing means, said guiding means being movable between operative and inoperative positions and further comprising detector means operative to initiate movement of said guiding means to inoperative position in response to advancement of the leader of the web beyond said second advancing means.

25. The combination of claim 12, wherein said first machine includes means for splicing a plurality of strips of photographic material end-to-end, a variable-capacity magazine for the web between said splicing means and said first advancing means, detector means for monitoring the operation of said splicing means, and means for varying the speed of first advancing means in response to detection of a malfunction of said splicing means.

26. The combination of claim 25, further comprising means for supplying to said splicing means at least one band of flexible material in lieu of one or more strips of photographic material in response to a reduction of the capacity of said magazine to a predetermined minimum acceptable value.

27. The combination of claim 10, wherein said at least one part of said developing machine includes a liquid-containing tank and said developing machine further comprises a drying unit for the web, said drying unit receiving the web from said at least one part and further comprising a third machine receiving the web from said drying unit, said third machine including a printer and an exhaustible supply of photographic paper so that the operation of said third machine must be interrupted when the supply of paper is to be restored, said drying unit having a web storing capacity which suffices to store that length of web which leaves said at least one part during interruption of operation of said third machine.

28. The combination of claim 27, further comprising a second developing machine disposed downstream of said printer and defining an additional portion of said path, said second developing machine having first variable-speed advancing means at the upstream end of the additional portion of said path, second variable-speed advancing means at the downstream end of said additional portion of said path, and means for varying the speed of said first advancing means in response to short-lasting interruptions of operation of said printer and for arresting said first advancing means in response to longer-lasting interruptions of operation of said printer.

29. The combination of claim 28, further comprising means for attaching to the web a strip of flexible material other than photographic material.

* * * * *